United States Patent [19]

Gruden

[11] Patent Number: 4,841,834

[45] Date of Patent: Jun. 27, 1989

[54] COMMAND OPERATED LIQUID METAL OPENING SWITCH

[75] Inventor: James M. Gruden, Cary, N.C.

[73] Assignee: The United States of America as represented by the Secretary of the Air Force, Washington, D.C.

[21] Appl. No.: 107,185

[22] Filed: Oct. 13, 1987

[51] Int. Cl.[4] ..... F41F 1/02

[52] U.S. Cl. ..... 89/8; 124/3; 200/81.6; 335/51

[58] Field of Search ..... 89/8; 124/3; 200/81.6; 335/47, 49, 51, 57, 58

[56] References Cited

U.S. PATENT DOCUMENTS

| | | | |
|---|---|---|---|
| 3,267,230 | 8/1966 | Schonfeld et al. | 200/81.6 |
| 4,138,600 | 2/1979 | Ozols | 200/61.47 |
| 4,208,643 | 6/1980 | Snaper et al. | 335/52 |
| 4,621,561 | 11/1986 | Weldon | 89/8 |

FOREIGN PATENT DOCUMENTS

| | | | |
|---|---|---|---|
| 581522 | 11/1977 | U.S.S.R. | 335/47 |
| 708428 | 1/1980 | U.S.S.R. | 335/47 |

*Primary Examiner*—Stephen C. Bentley

*Attorney, Agent, or Firm*—Fredric L. Sinder; Donald J. Singer

[57] ABSTRACT

A very low inductance, very low resistance, command operated repetitive high current opening switch is described which uses a Lorentz force to move a conductive liquid between a conducting region and an insulated region between two electrodes. In a specific embodiment, a cylindrical outer electrode coaxially surrounds in a spaced relationship a generally cylindrical inner electrode. The annular space between the inner and outer electrodes is divided into first and second sections along the length of the electrodes. Intermeshing continuous spiral fins are defined on the facing surfaces of the inner and outer electrodes along the first section of the length of the opening switch. Insulation covers the surfaces of the inner and outer electrodes surrounding the second section. An electrically conductive liquid is sealed inside the first and second annular sections in an amount sufficient to substantially fill only one of the annular sections, so that electric current can flow between the outer electrode and the inner electrode through the liquid whenever any of the liquid is inside the first annular section, but the insulation prevents the flow of electric current flow between the outer electrode and the inner electrode when all of the liquid is inside the second annular section. A pulsed magnetic field created by a coil surrounding the first annular section outside the outer electrode produces a tangental Lorentz force which corkscrews the conductive fluid from one annular section to another.

6 Claims, 6 Drawing Sheets

COMMAND OPERATED LIQUID METAL OPENING SWITCH

RIGHTS OF THE GOVERNMENT

The invention described herein may be manufactured and used by or for the Government of the United States for all governmental purposes without the payment of any royalty.

BACKGROUND OF THE INVENTION

The present invention relates generally to high current opening switches, and more specifically to a very low inductance, very low resistance, command operated repetitive high current opening switch for railguns.

Railguns are being considered as a primary component of a space based ballistic missile defense system. One of the limiting components in a railgun system is the opening switch. The opening switch is required to conduct high currents for long periods of time and then quickly open to commutate, or switch, current into the railgun. In addition, the opening switch must be able to operate repetitively.

Railguns operate by using a very high electric current to create a very strong magnetic field. The vector cross product of the magnetic field with the current is called a Lorentz force. The Lorentz force will propel an electrically conductive projectile between a pair of electrically conductive rails. The projectile experiences several 100,000's of g's as it accelerates down the railgun barrel and can obtain muzzle velocities of several kilometers per second.

The very high railgun currents place tremendous energy dissipation demands on the opening switch. The amount of switching energy dissipated by the opening switch is primarily a function of the switch inductance. The prior art includes actual and proposed railgun opening switches of successively lower switch inductances, but even longer switch inductances will be required to increase the system efficiencies of space based rapid fire railguns. An example of an improved very low inductance opening switch is shown in the inventor's co-pending patent application Ser. No. 06/861,899, filed May 12, 1986, for a rotary opening switch, now U.S. Pat. No. 4,738,181, incorporated by reference as if fully rewritten herein.

Another factor affecting the amount of switching energy to be dissipated by the opening switch is its resistance to current flow. A lower resistance both increases the overall efficiency of the system and reduces the amount of heat to be dissipated by the switch. Prior art switches generally use brushes to conduct current. Despite many improvements in brush design, such as the use of finger brushes as described in the aforementioned co-pending patent application, brushes are inherently limited in how low a resistance they can provide at very high currents.

The need for repetitive operation capability has been satisfied in the prior art primarily by using rotating opening switches. Such switches, however, may be switched on and off only at set rates according to their rates of rotation. Further, such rotary switches start sluggishly and stop slowly.

It is thus seen that there is a need for a railgun opening switch of very low switch inductance, very low switch resistance and capable of being switched on and off at variable rates on command.

It is, therefore, a principal object of the present invention to provide a very low inductance, very low resistance, command operated repetitive railgun opening switch.

It is a feature of the present invention that it will work in any orientation relative to the rails.

It is another feature of the present invention that it may include a hollow center coaxial with the projectile path to allow breech loading and preacceleration of the projectile.

SUMMARY OF THE INVENTION

In accordance with the foregoing principles, objects and features, the present invention provides a novel very low inductance, very low resistance, command operated repetitive railgun opening switch. The unique discovery of the present invention is a novel very low inductance configuration of a liquid metal switch which uses a Lorentz force to move the liquid metal from a conducting position to a non-conducting position and which provides extremely fast on and off operation. The large surface area and the wetting action of the liquid metal provide the opening switch a very low resistance in its closed state.

Accordingly, the present invention is directed to an opening switch comprising a generally cylindrical outer electrode coaxially surrounding in a spaced relationship a generally cylindrical inner electrode. The annular space between the inner and outer electrode is divided into first and second annular sections. Insulating means separate the inner and outer electrodes defining the second annular section. An electrically conductive liquid is sealed inside the first and second annular sections in an amount sufficient to substantially fill only one of the annular sections, so that electric current can flow between the outer electrode and the inner electrode through the liquid whenever any of the liquid is inside the first annular section, and so that the insulating means prevents the flow of electric current flow between the outer electrode and the inner electrode when all of the liquid is inside the second annular section. Means for moving the liquid between the first and second annular sections opens and closes the switch.

The invention also includes a substantially coaxial opening within the inner electrode.

The means for moving the liquid between the first and second annular sections may comprise intermeshing continuous sprial fins on the facing surfaces of the inner and outer electrodes inside the first annular section. Means for creating a magnetic field surround the first annular section outside the outer electrode.

The means for moving the liquid may further include means for supplying pressurized gas to each of the first and second annular sections.

The means for creating a magnetic field may comprise an electrically conductive coil outside the outer electrode substantially surrounding the first annular section and a source of electric current for energizing the coil.

The invention also includes the general method and apparatus for using a Lorentz force to move a conductive liquid between on and off positions in the space between a pair of electrodes.

DESCRIPTION OF THE DRAWINGS

The present invention will be more clearly understood from a reading of the following detailed description in conjunction with the accompanying drawings wherein.

DETAILED DESCRIPTION

Figure 1:
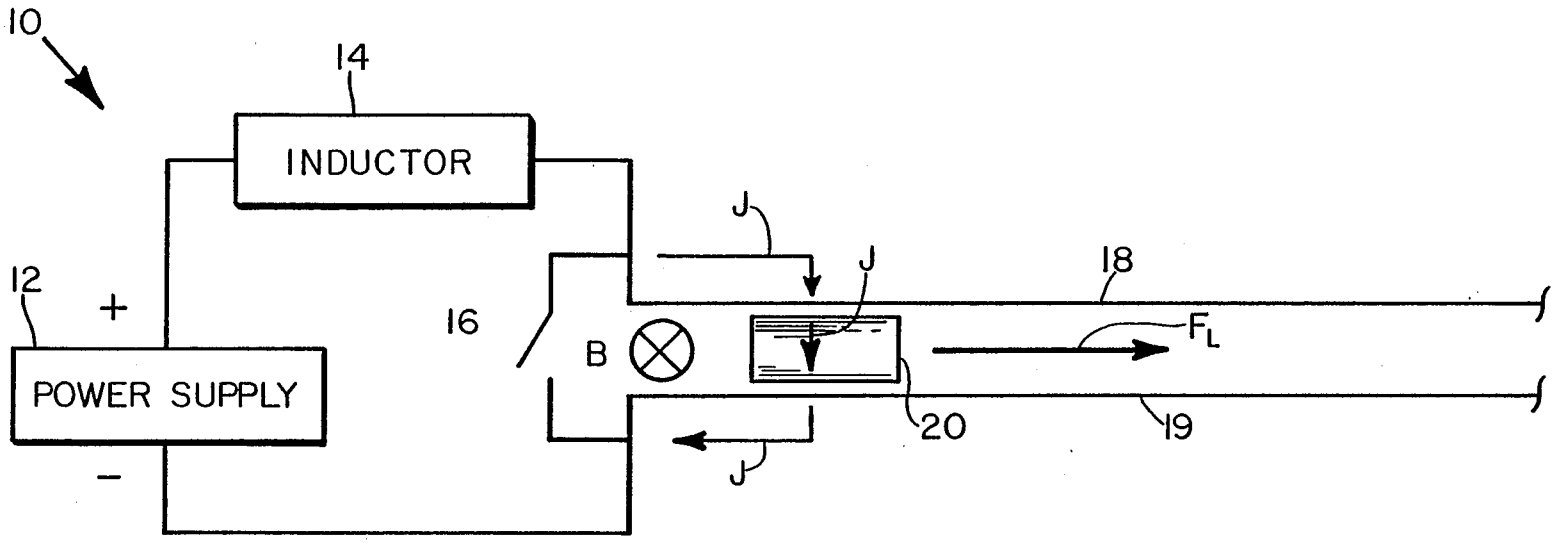
PRIOR ART Fig. 1
FIG. 1 is a schematic of a typical prior art railgun circuit.

Referring now to FIG. 1, there is shown a typical prior art rail gun circuit 10. The problems to be solved in a railgun opening switch will be better understood from a more detailed understanding of the operation of a railgun. Circuit 10 comprises a power supply 12, an inductor 14, an opening switch 16, a pair of rails 18 and 19 and a projectile 20. An opening switch 16 is located at the breech of the railgun and is normally closed. When closed, switch 16 has a resistance substantially less than that of the alternate electrical path through rails 18 and 19 and the projectile 20. Current from power supply 12 flows through inductor 14, storing large amounts of energy in its magnetic field. When switch 16 is opened, the energy stored in inductor 14 is suddenly released through the rail-projectile-rail path at rates much faster than can be supplied by the power supply alone. Practical railgun circuits will develop megampere level currents. Current flowing along the rails in the conventional direction from positive to negative will, by application of the right hand rule, produce a magnetic field vector B directed into the page to the left of projectile 20. The vector cross product of a downwardly directed current vector J, passing through projectile 20, with magnetic field vector B produces a Lorentz force vector $F_L$ directed toward the right, propelling projectile 20 along rails 18 and 19.

The need for rapid fire capability imposed by present concepts for the use of space based railguns requires repetitive switching. Repetitive switching places tremendous energy dissipation requirements on the switch because it must dissipate the commutation, or switching, energy. Commutation energy is a function of the commutation inductance created by the circuit of the switch 16, rails 18, 19 and projectile 20. When the switch is opened, stored commutation energy must be either recovered, as in a counter pulse capacitor, or dissipated by arcing or resistance heating. The commutation energy is expressed as $\frac{1}{2}L_{com}I^2$, where $L_{com}$ is the commutation inductance (the sum of the switch $L_{sw}$ and load $L_{ld}$ inductances), and I is the current.

With I fixed by the railgun power requirements in the range of several megamperes, a simple calculation shows that even a $L_{com}$ as low as 100 nanoHenrys (nH, where $n=10^{-9}$) results in a commutation energy of several hundred thousand joules, too high to allow a switch repetitively firing at 10 Hz to survive. Because both I and $L_{ld}$ are largely fixed in a railgun, the most effective means to reduce the required dissipation energy is to design switch 16 to minimize its switch inductance. Additional calculations have shown that a minimum desired switch inductance is in the range of 10–20 nH. Inductance being a direct function of loop size, a practical railgun must have the size of the loop circuit formed by switch 16, rails 18, 19, and projectile 20 be as small as possible. The aforementioned co-pending patent application, Ser. No. 06/861,899, provides additional details of prior art attempts at reducing loop size to reduce switch inductance.

Figure 2:
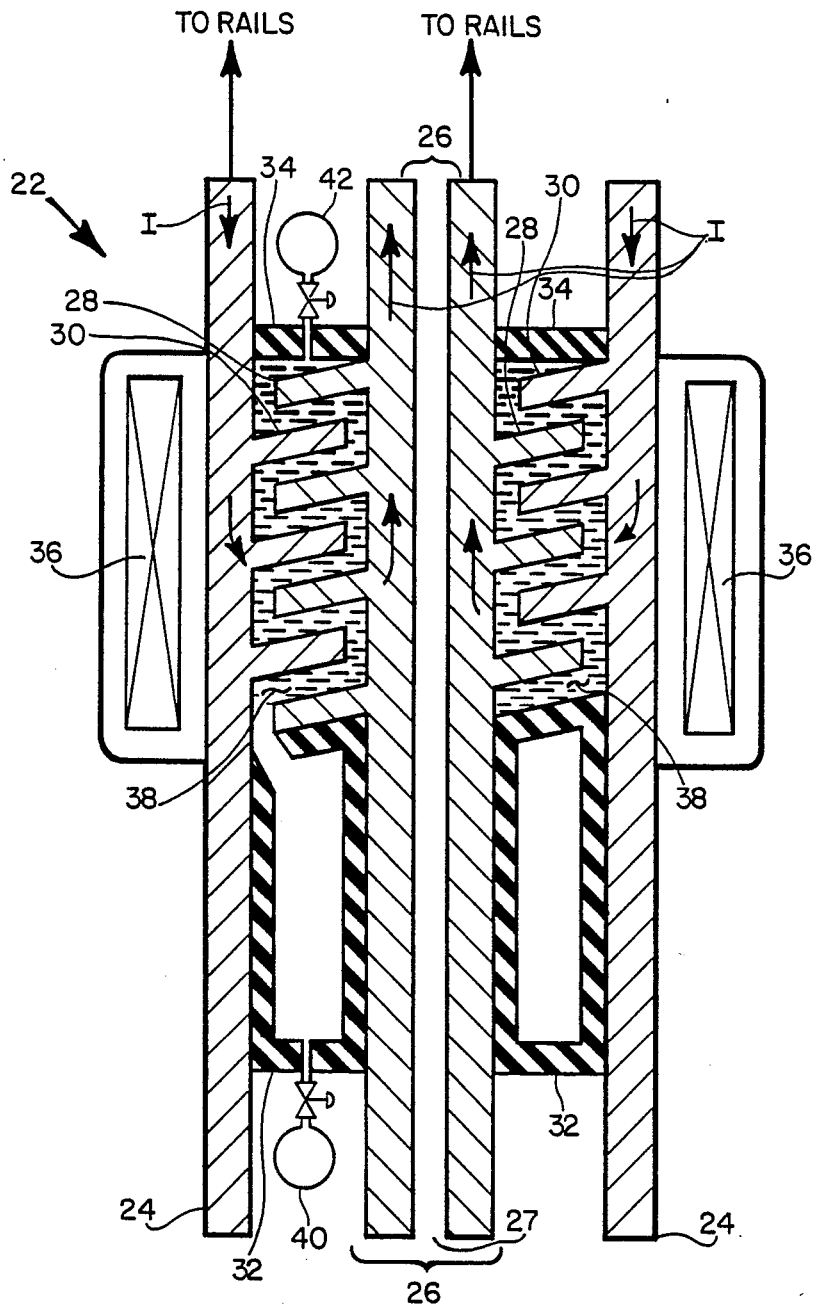
FIG. 2 is a simplified cross-sectional view of a railgun opening switch according to the teachings of the present invention, showing the switch in its on, or closed, state.
Figure 3:
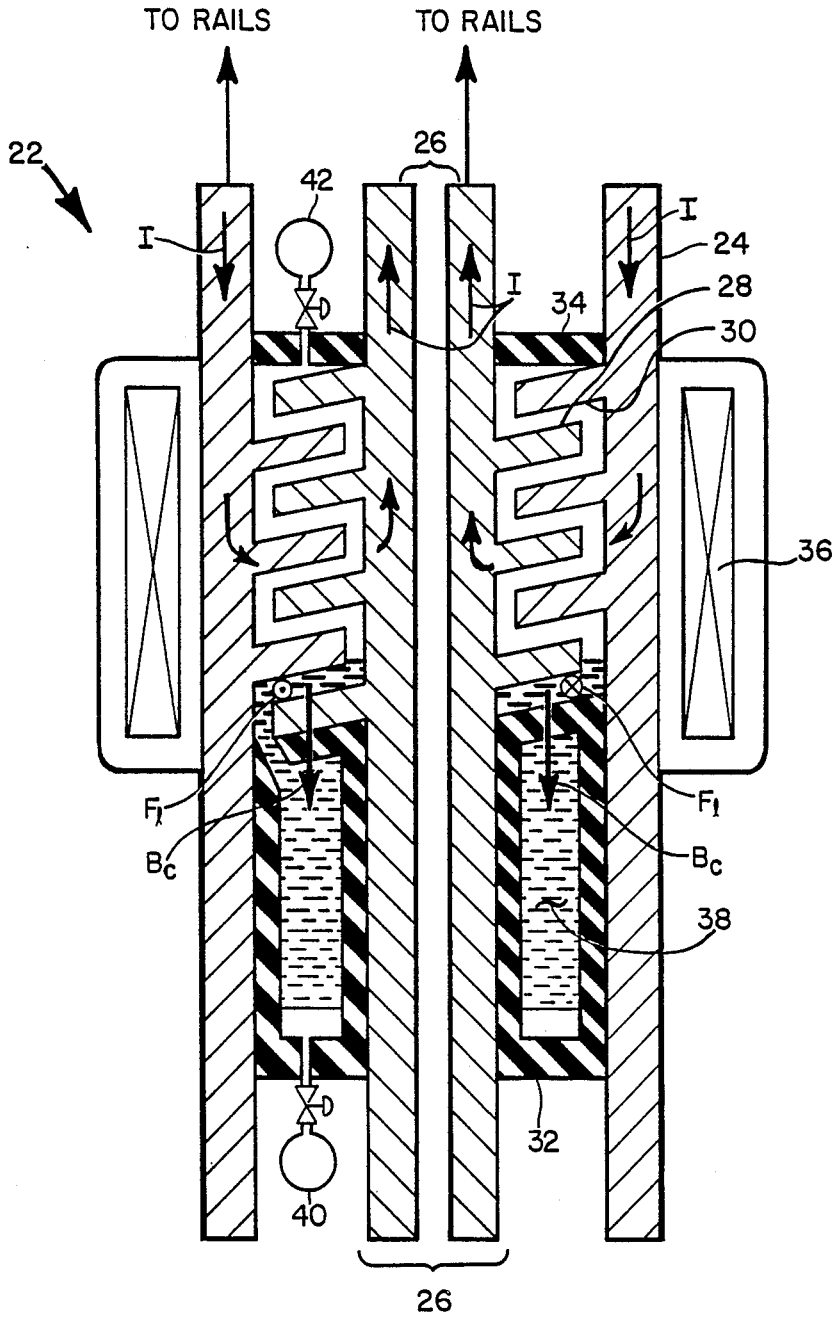
FIG. 3 is a simplified cross-sectional view of the railgun opening switch showing the switch in its commutation, or switching, state.
Figure 4:
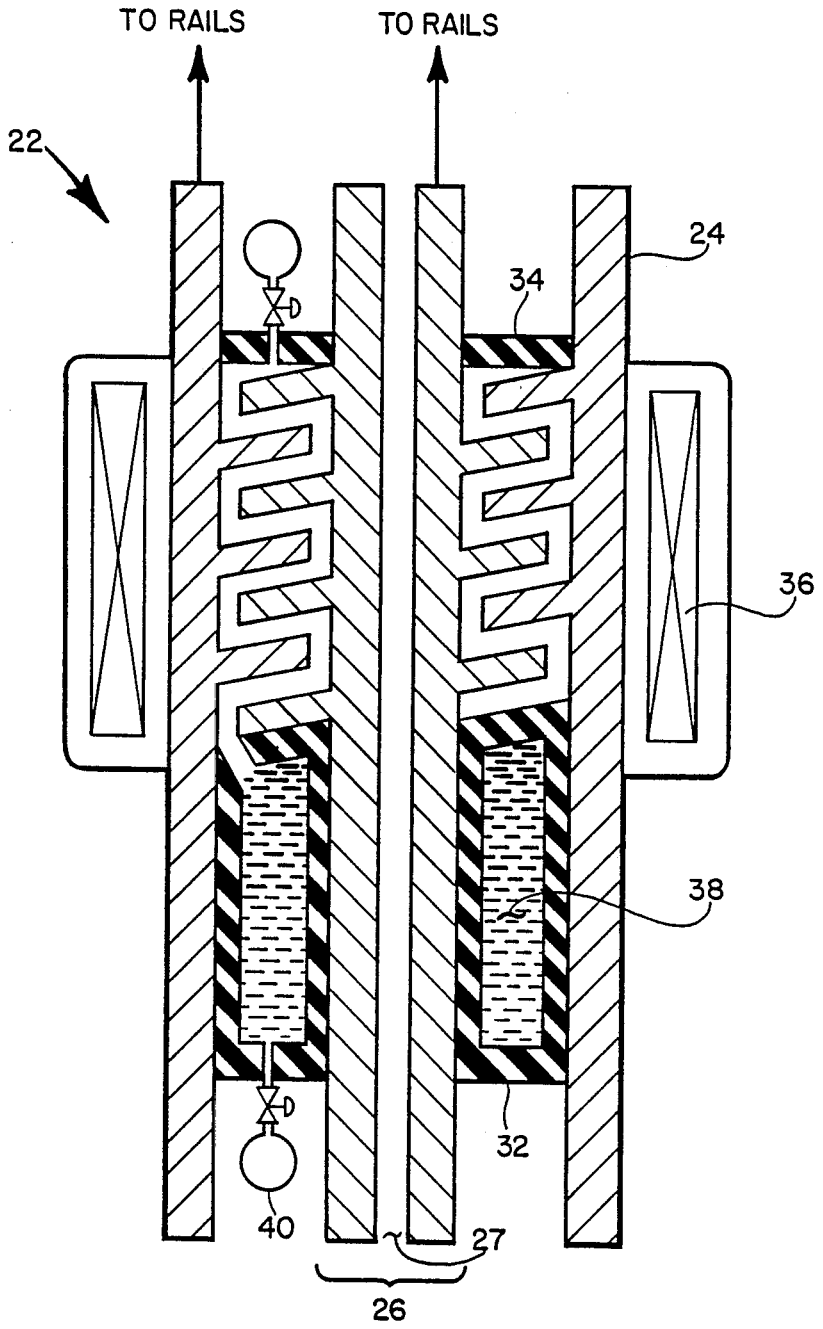
FIG. 4 is a simplified cross-sectional view of the railgun opening switch showing the switch in its off, or open, state.
Figure 5:
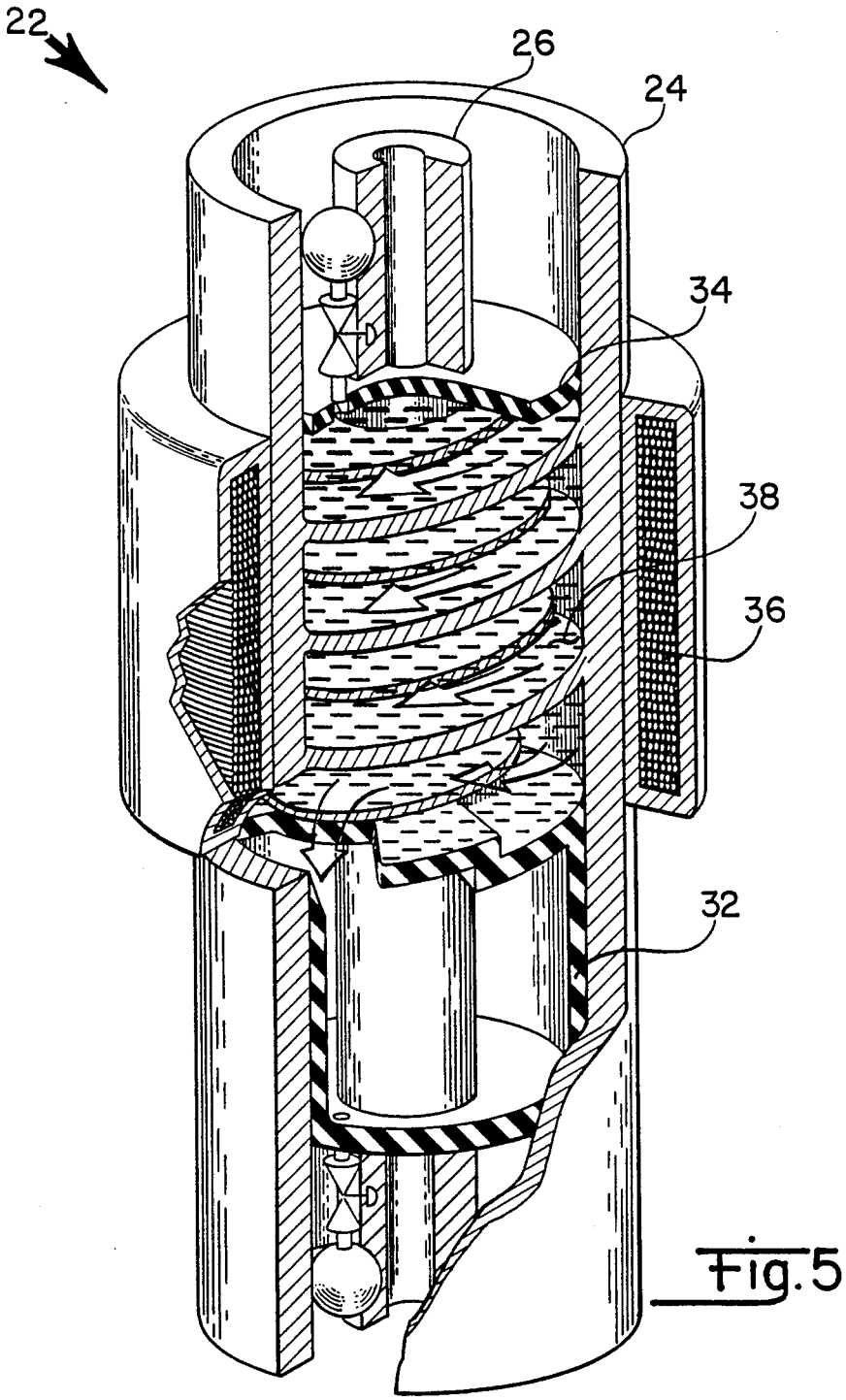
FIG. 5 is a perspective view of the railgun opening switch of FIGS. 2–4, showing the switch in the one state of FIG. 2; and, FIG. 6 is a simplified substantially cross-sectional view of a railgun opening switch according to the teachings of the present invention showing another embodiment of the switch attached between a pair of railgun rails and associated railgun circuitry.

Referring now to FIGS. 2, 3 and 4 of the drawings, there are shown three simplified cross-sectional views of a railgun opening switch 22 according to the teachings of the present invention. FIG. 5 shows a perspective view of the opening switch of FIGS. 2–4. Switch 22 comprises a cylindrical outer electrode 24 surrounding a coaxially located cylindrical inner electrode 26. Inner electrode 26 additionally includes a hollow center 27. Electrodes 24 and 26 extend from opening switch 22 to form terminals for attachment to a railgun circuit. A continuous spiral fin 28 extends outwardly from inner electrode 26 along a first section of its length. A continuous spiral fin 30 extends inwardly from outer electrode 24 to intermesh with spiral fin 28 along a corresponding first section of the length of outer electrode 24. Spiral fins 28 and 30 do not touch.

Insulating material 32 forms an annular chamber separating inner electrode 26 from outer electrode 24 along a second section of their length separate from the spiral fin sections. Additional insulating material 34 forms an annular seal between the electrodes on the other side of the spiral fins section from the insulating chamber section of switch 22.

An external coil 36 surrounds outer electrode 24 and inner electrode 26 outside the spiral fins section of switch 22.

FIG. 2 shows an electrically conductive liquid metal 38, such as NaK, an eutectic of sodium and potassium, or mercury, filling the space between spiral fins 28 and 30. The volume of liquid metal 38 is sufficient to fill only one of the first or second length sections of the annular space between inner electrode 26 and outer electrode 24. FIG. 3 shows liquid metal 38 partially filling both the spiral fins section and the insulating chamber section of switch 22. FIG. 4 shows liquid metal 38 completely inside the insulating chamber section.

Pressurized gas supplies 40 and 42 are interconnected to the inside of the opening switch through insulating material 32 and 34 as shown in the drawings.

The operation of the opening switch will be understood by inspection of the drawings along with the following description. The switch operates primarily by moving liquid metal 38 back and forth between the spiral fins section and the insulating chamber, thereby alternately permitting and preventing the flow of railgun current I from electrode 24 to electrode 26 through liquid metal 38. Liquid metal 38 is moved from one section to another primarily by a Lorentz force augmented by gas pressure.

When switch 22 is closed, liquid metal 38 fills the spiral fins section of the switch and conducts current I to store energy as explained in the FIG. 1 description of a typical railgun circuit. A combination of the baffle effect of spiral fins 28 and 30 and gas pressure supplied from pressurized gas supply 40 contains liquid metal 38 in its conducting position.

A comparison of switch 22 in its closed configuration with the typical railgun circuit of FIG. 1 shows that, in the absence of spiral fins 28 and 30, a Lorentz force created by the flow of current I from outer electrode 24 to inner electrode 26 through liquid metal 38 will move liquid metal 38 from the spiral fins section to the insulating chamber section in a manner analogus to the Lorentz force that moves projectile 20 along rails 18 and 19. Careful analysis by those with skill in the art will show that, in addition to the mechanical baffle effect of spiral fins 28 and 30, the fins modify the path of current I from outer electrode 24 to inner electrode 26 to produce a number of Lorentz force vectors that tend to cancel each other to reduce the overall Lorentz force tending to move liquid metal 38 from one section to another. The remaining reduced Lorentz force is balanced by the force provided by pressurized gas from gas supply 40.

When it is desired to move liquid metal 38 from the spiral fins section of switch 22 to the insulating chamber section and thereby switch, or cummutate, current I to the rails, external coil 36 is pulsed by a separate, lower current source (not shown) to create a magnetic field $B_c$, shown in FIG. 3. Substantially all the resulting vector forces $F_1$ of the vector cross products of the currents from outer electrode 26 to inner electrode 24 with magnetic field $B_c$ are in tangental directions to spiral fins 28 and 30, or into and out of the page as shown in FIG. 3. Liquid metal 38 is thus forced in corkscrew fashion (as indicated in FIG. 5) out of the spiral fins section of switch 22 into the insulating chamber section, thereby opening the switch and commutating the current. Pressurized gas from gas supply 42 augments this movement. FIG. 4 shows switch 22 in its fully open state.

To reclose switch 22, pressurized gas in introduced from pressurized gas supply 40 to start the flow of liquid metal 38 into the spiral fins section of switch 22. Coil 36 is then pulsed in the reverse direction so that the now reversed Lorentz force will corkscrew liquid metal 38 further into the spiral fins section to complete closure of the switch.

Figure 6:
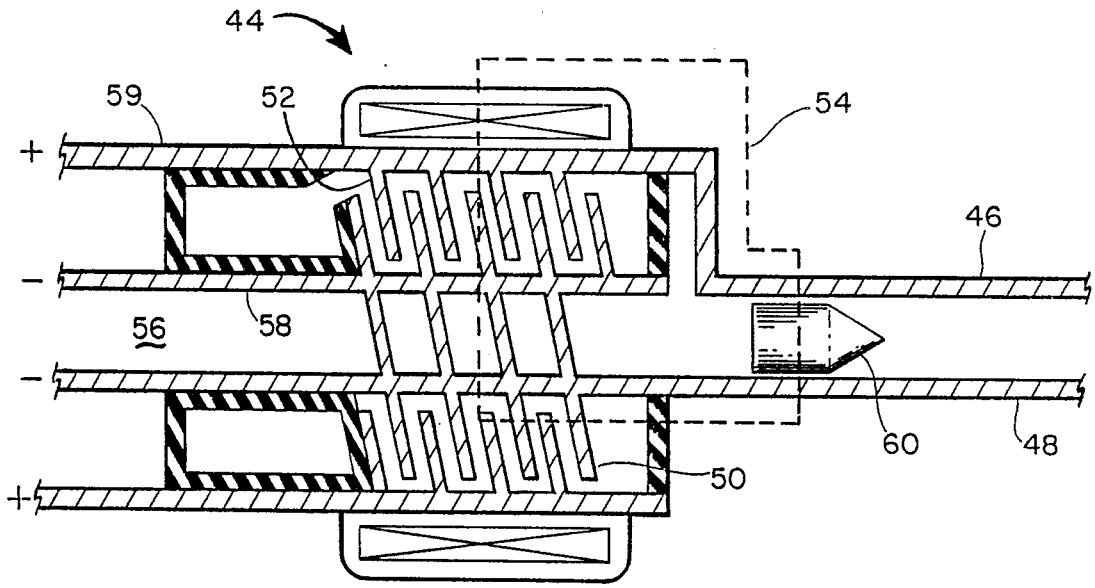

FIG. 6 is a schematic cross-sectional view of a railgun openign switch 44 connected between the positive and negative outputs of associated railgun circuitry (not shown) and a pair of railgun rails 46 and 48. Spiral fin 50, extending from inner electrode 58, is shown in a modified edge view to provide a more understandable view of the relationship between spiral fin 50 and spiral fin 52, extending from inner electrode 59, than is apparent from the other figures. The low inductance provided by switch 44 is indicated by the small size of inductance loop 54. Hollow center 56 of inner electrode 58 provides a path for projectile 60.

Those skilled in the art will see that the FIG. 6 embodiment of a railgun opening switch will result in a Lorentz force tending to maintain the liquid metal switch in a closed state during current flow before pulsing the external magnetic field. The FIG. 6 embodiment may be changed to operate the same as the embodiment of FIGS. 2–5 simply by reversing the polarity of the positive and negative outputs of the associated railgun circuitry.

Those skilled in the art will also see that the unique configuration and mode of operation of switch 44 permits the use of hollow center 56 of inner electrode 58 not only as a path for the projectile, but also to preaccelerate the projectile, or even as the first stage of a multi-stage reilgun.

Those skilled in the art will further see that the insulating material need not cover the surfaces of the electrodes in the insulating section as shown, but need only electrically insulate one electrode from another by a variety of functionally equivalent structures.

It is understood that other modifications to the invention as described may be made, as might occur to one with skill in the field of the invention, within the intended scope of the claims. Therefore, all embodiments contemplated have not been shown in complete detail. Other embodiments may be developed without departing from the spirit of the invention or from the scope of the claims.

I claim:

1. An opening switch, comprising:

(a) a generally cylindrical outer electrode having an inside surface;

(b) a generally cylindrical inner electrode substantially coaxial with the outer electrode and having an outside surface in a spaced relationship from the inside surface of the outer electrode, the inside surface of the outer electrode and the outside surface of the inner electrode defining adjacent first and second annular sections between the outer electrode and the inner electrode;

(c) insulating means inside the second annular section for electrically insulating the inside surface of the outer electrode from the outside surface of the inner electrode;

(d) an electrically conductive liquid sealed inside the first and second annular sections in an amount sufficient to substantially fill only one of said annular sections, so that electric current can flow between the outer electrode and the inner electrode through said liquid whenever any of said liquid is inside the first annular section and so that the insulating means prevents the flow of electric current between the outer electrode and the inner electrode when all of said liquid is inside the second annular section; and, (e) means for moving said liquid between the first and second annular sections, wherein the moving means comprise:

(i) an outwardly extending spiral fin defined on the outside surface of the inner electrode in the first annular section;

(ii) an inwardly extending spiral fin defined on the inside surface of the outer electrode in the first annular section wherein the inner electrode spiral fin and the outer electrode spiral fin substantially mesh in a spaced relationship; and, (iii) means for creating a magnetic field, said means substantially surrounding the first annular section.

2. The opening switch according to claim 1, wherein the means for moving said liquid between the first and second annular sections further comprises means for supplying pressurized gas to the first and second annular sections.

3. The opening switch according to claim 2, wherein the means for creating a magnetic field comprise:

(a) an electrically conductive coil outside the outer electrode substantially surrounding the first annular section; and, (b) a source of electric current for energizing the coil.

4. A railgun, comprising:

(a) means for supplying an electrical current;
(b) an inductor electrically connected to the current supplying means;
(c) a pair of rails, one rail electrically connected to the current supplying means and the other rail electrically connected to the inductor;
(d) a projectile for being propelled along a path defined by the rails;
(e) an opening switch electrically connected across the rails, said opening switch comprising a generally cylindrical outer electrode having an inside surface;
(f) a generally cylindrical inner electrode substantially coaxial with the outer electrode and having an outside surface in a spaced relationship from the inside surface of the outer electrode, the inside surface of the outer electrode and the outside surface of the inner electrode defining adjacent first and second annular sections between the outer electrode and the inner electrode;
(g) insulating means inside the second annular section for electrically insulating the inside surface of the outer electrode from the outside surface of the inner electrode;
(h) an electrically conductive liquid sealed inside the first and second annular sections in an amount sufficient to substantially fill only one of said annular sections, so that electric current can flow between the outer electrode and the inner electrode through said liquid whenever any of said liquid is inside the first annular section and so that the insulating means prevents the flow of electric current between the outer electrode and the inner electrode when all of said liquid is inside the second annular section; and,
(i) means for moving said liquid between the first and second annular sections, wherein the moving means comprise:
  (i) an outwardly extending spiral fin defined on the outside surface of the inner electrode in the first annular section;
  (ii) an inwardly extending spiral fin defined on the inside surface of the outer electrode in the first annular section wherein the inner electrode spiral fin and the outer electrode spiral fin substantially mesh in a spaced relationship; and,
  (iii) means for creating a magnetic field, said means substantially surrounding the first annular section.

5. The opening switch according to claim 4, wherein the means for moving said liquid between the first and second annular sections further comprises means for supplying pressurized gas to the first and second annular sections.

6. The opening switch according to claim 4, wherein the means for creating a magnetic field comprise:
(a) an electrically conductive coil outside the outer electrode substantially surrounding the first annular section; and,
(b) a source of electric current for energizing the coil.

* * * * *